US007118104B2

(12) United States Patent
Forche et al.

(10) Patent No.: US 7,118,104 B2
(45) Date of Patent: Oct. 10, 2006

(54) GRIPPER SYSTEM FOR A MACHINE WHICH PROCESSES PRINTING MATERIAL SHEETS

(75) Inventors: Jens Forche, Freinsheim (DE); Hans-Peter Hiltwein, Waghäusel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 331 days.

(21) Appl. No.: 10/834,758

(22) Filed: Apr. 27, 2004

(65) Prior Publication Data

US 2004/0244864 A1 Dec. 9, 2004

(30) Foreign Application Priority Data

Jun. 5, 2003 (DE) ..... 103 25 376

(51) Int. Cl.
*B65H 5/14* (2006.01)
*B65H 5/08* (2006.01)
*B41F 21/04* (2006.01)

(52) U.S. Cl. ..... 271/277; 271/204; 271/82; 269/275; 269/286; 101/408

(58) Field of Classification Search ..... 271/277, 271/204, 82; 101/408; 269/265, 267, 245, 269/275, 274
See application file for complete search history.

(56) References Cited

U.S. PATENT DOCUMENTS 1,271,329 A * 7/1918 Kyle ..... 101/412
4,203,363 A * 5/1980 Walter et al. ..... 101/409
4,427,193 A 1/1984 Kahlert et al.
4,823,698 A * 4/1989 Ruger et al. ..... 101/409
4,947,748 A * 8/1990 Hiltwein et al. ..... 101/409
4,970,955 A * 11/1990 Sondergeld et al. ..... 101/409

FOREIGN PATENT DOCUMENTS

DE 29 24 943 A1 4/1980
DE 30 31 123 A1 5/1981
DE 31 46 836 A1 8/1982

* cited by examiner

*Primary Examiner*—Gene O. Crawford
*Assistant Examiner*—Kaitlin Joerger
(74) *Attorney, Agent, or Firm*—Laurence A. Greenberg; Werner H. Stemer; Ralph E. Locher

(57) ABSTRACT

A gripper system for a machine that processes printing material sheets has a gripper with a first clamping surface and a gripper pad, for cooperating with the gripper, with a second clamping surface. One of the two clamping surfaces is formed with a surface relief. The clamping surface which has the surface relief is placed in such a way that, when a narrow printing material sheet is gripped, the clamping surface is covered by the sheet only within a subregion of the clamping surface and, when it grips a broad printing material sheet, it is covered by the latter beyond the subregion. The surface relief is structured differently within the subregion than outside the subregion, in that it is provided within the subregion with an antideformation structure which protects the narrow printing material sheet from excessive clamping deformation.

23 Claims, 7 Drawing Sheets

GRIPPER SYSTEM FOR A MACHINE WHICH PROCESSES PRINTING MATERIAL SHEETS

BACKGROUND OF THE INVENTION

Field of the Invention

The present invention relates to a gripper system for a machine that processes printing material sheets. The gripper system includes a gripper having a first clamping surface and a gripper pad which cooperates with the gripper and has a second clamping surface. One of the two clamping surfaces has a surface relief.

German published patent application DE 31 46 836 A1 describes a gripper system, the clamping surface of which has a surface relief formed from prismatic profile elements. Two situations can be assumed with regard to that clamping surface.

There is no problem in one situation in which the clamped printing material sheet completely covers the clamping surface. In this situation, the clamping force acts over the entire clamping surface as intended and, as a result, the surface pressure exerted by the clamping surface on the printing material sheet is not excessive. The surface relief or its prismatic profile elements only dig into the printing material sheet as deeply as is necessary in order to hold the printing material sheet securely in the gripper system.

In the other situation, which is indeed problematic, the clamping surface is only half covered by the sheet corner of the clamped printing material sheet in the direction of its sheet width. As a result, the clamping force, whose magnitude is unchanged with respect to the first situation, is now distributed exclusively in the partial region of the clamping surface that is covered by the printing material sheet and no longer over the entire clamping surface. This concentration of the clamping force in turn has the consequence that the surface pressure acting on the clamped printing material sheet is increased with regard to the first situation and, for example, is approximately doubled, and that the prismatic profile elements dig into the printing material sheet to an excessive depth. The increase in the surface pressure and the excessive digging in of the profile elements can lead to excessively pronounced irreversible sheet deformations, so-called clamping marks, in the region of the affected sheet corner of the printing material sheet.

As every one of the printing material sheets gripped one after another by the gripper system would have such clamping marks, problems would be expected as a consequence when stacking the printing material sheets on top of one another subsequently.

If there is provision for the printing material sheets to be stacked on top of one another so as to form a sheet stack by means of a sheet delivery of the machine comprising the gripper system, there would be an accumulation of the clamping marks. This is because the clamping mark of every printing material sheet would come to rest within the sheet stack exactly over the clamping mark of the printing material sheet lying underneath. A serious deviation of the sheet stack geometry from the required parallelepiped sheet stack geometry is to be expected in the region of the deformed (warped, rippled, etc.) sheet corners. This distortion of the sheet stack edges at least considerably impedes the further processing of the printing material sheets of the sheet stack or perhaps even makes the further processing completely impossible. This is because an exact sheet stack geometry is a precondition for the unproblematic further processing of the stack.

SUMMARY OF THE INVENTION

It is accordingly an object of the invention to provide a gripper system for a machine that processes printing sheet material which overcomes the above-mentioned disadvantages of the heretofore-known devices and methods of this general type and which provides for a gripper system that grips the printing material sheet in a manner which is gentle to the printing material sheet, even given an unfavorable position of the printing material sheet relative to the clamping surface.

With the foregoing and other objects in view there is provided, in accordance with the invention, a gripper system for a sheet-processing machine, comprising:

a gripper having a first clamping surface;

a gripper pad disposed to cooperate with the gripper and having a second clamping surface;

one of the first and second clamping surfaces having a surface relief and being disposed such that, when gripping a relatively narrow printing material sheet, the sheet covers only a subregion of the clamping surface and, when gripping a relatively broad printing material sheet, the sheet covers the clamping surface beyond the subregion; and the surface relief having a structure within the subregion different from a structure of the clamping surface outside the subregion, and the structure within the subregion having an antideformation structure protecting the narrow printing material sheet against excessive clamping deformation.

In other words, the gripper system comprises a gripper having a first clamping surface and a gripper pad which cooperates with the gripper and has a second clamping surface, one of the two clamping surfaces having a surface relief. The invention is characterized by a novel clamping surface in which the surface relief is placed in such a way that, when gripping a narrow printing material sheet, it is covered by the latter only within a subregion of the clamping surface and, when gripping a broad printing material sheet, it is covered by the latter beyond the subregion, and in that the surface relief is structured differently within the subregion than outside the subregion, in that it is provided within the subregion with an antideformation structure which protects the narrow printing material sheet from excessive clamping deformation.

The advantages of the gripper system according to the invention are multifarious.

The gripper system is suitable for use in a machine in which the gripper system is moved with a high sheet transport speed. A machine of this type can be, for example, a sheet-fed printing press which achieves a high printing speed. The high sheet transport speed is associated with high loading of the printing material sheet held in a clamped manner in the gripper system as a result of external forces and involves the risk of the printing material sheet slipping out of the gripper system under the influence of the external forces. In order to prevent this, the clamping force of the gripper system which acts between the clamping surfaces must be of sufficiently great dimensions. Once again, as the magnitude of the clamping force rises, so does the risk of excessive clamping deformation of the printing material sheet, if the sheet width of the latter is unfavorable in relation to the design conditions of the gripper system and, as a consequence, the printing material sheet does not cover the whole clamping surface but only the subregion of the latter. In the gripper system according to the invention, however, a countermeasure preventing excessive clamping deformation is implemented which consists of the antideformation structure.

Furthermore, the advantages of the gripper system according to the invention are shown when the latter is contained multiply and in a large number in the machine which processes the printing material sheets. This would be the case, for example, in a sheet-fed printing press of in-line construction which has a large number of printing units arranged one after another and in which the impression cylinders of the printing units and the sheet transport cylinders arranged between the impression cylinders and the chain conveyor of a sheet deliverer of the sheet-fed printing press are equipped with gripper systems of the type according to the invention. In a machine of this type, the printing material sheet is stressed as it passes through the machine at one and the same clamping point, for example the front right sheet corner, by the gripper systems gripping the printing material sheet one after another by means of their clamping surfaces having the surface relief. The antideformation structure of the clamping surfaces which repeatedly mark the printing material sheet at the same location prevent the clamping deformation of the printing material sheet assuming such a magnitude during this extreme sheet stressing that it is possible to process the printing material sheet further only under more difficult conditions or it is no longer possible at all.

Furthermore, the gripper system according to the invention is extremely suitable for gripping printing material sheets composed of sensitive material, in particular very thin or very soft printing material sheets which tend to suffer clamping deformations in a particularly pronounced manner and therefore have to be gripped particularly gently.

The clamping surface which has the surface relief which is provided with the antideformation structure can be the (first) clamping surface of the gripper and is preferably the (second) clamping surface of the gripper pad which cooperates with the (first) clamping surface during clamping.

Some advantageous refinements of the gripper system according to the invention will be explained briefly in the following text.

The gripper system holds each printing material sheet in a clamped manner at a sheet edge extending parallel to the gripper system, for example the leading edge or sheet front edge. The sheet edge extends substantially perpendicular to the sheet transport direction of the clamped printing material sheet. In the extent of this sheet edge, the surface relief or profile can change gradually or suddenly for the purpose of forming the antideformation structure. Here, the surface relief can change with respect to its support proportion related to the surface area unit, for example square centimeters, and/or the profile depth and/or the profile type. The support proportion is the proportion of the raised surface supporting the printing material sheet on the overall surface area of the surface area unit. The surface relief can have a deeper or more pronounced profile outside the subregion having the antideformation structure than within the subregion. For example, the region of the antideformation structure can be provided with a surface profile which is more uniform or has a smoother surface than the other surface profile, lying outside the subregion of the antideformation structure, of the clamping surface. If the change in the profile type is sudden, then the boundary is clearly visible which extends between the one profile type of the antideformation structure and the other profile type of the part, lying outside the antideformation structure, of the surface relief. In the other case, when the one profile type merges gradually into the other profile type, no boundary which can be clearly localized is visible.

In accordance with an added feature of the invention, at least one raised profile element, lying within the antideformation structure, of the surface relief is designed differently than raised profile elements, lying outside the antideformation structure, of the surface relief. The at least one raised profile element of the antideformation structure can be the only raised profile element of the antideformation structure and have the shape of a planar and substantially closed surface. In this special case, the region of the antideformation structure would be provided with a "smooth structure", that is to say actually unstructured. However, it is likewise possible for a plurality of raised profile elements, lying within the antideformation structure, of the surface relief to be designed differently than the raised profile elements, lying outside the antideformation structure, of the surface relief. The profile elements of the surface relief can be designed differently than one another with regard to their acuteness and/or their height. There may thus be provision, for example, for the at least one or every raised profile element lying within the antideformation structure to be designed to be blunter and/or lower than the raised profile elements lying outside the antideformation structure. For example, the greater degree of bluntness in the abovementioned case of the profile element forming the antideformation structure on its own may result from its plateau being larger, with regard to the plateau surface area, than every plateau surface area of the profile elements lying outside the antideformation structure. The or every raised profile element lying within the antideformation structure may be lower by a specific step height, that is to say protrude less in the direction of the printing material sheet, than the raised profile elements lying outside the antideformation structure which protrude out of the clamping surface to a greater extent.

In accordance with a further refinement of the invention, the surface relief has raised profile elements, each of which within the antideformation structure has a different profile than outside the antideformation structure. Every one of these profile elements therefore extends beyond the boundary of the antideformation structure, it being possible to localize the boundary to a greater case in one case and to a lesser extent in the other case. For example, each of the raised profile elements within the antideformation structure can have a blunter and/or lower profile than outside the antideformation structure. Accordingly, one and the same profile element can have a comparatively blunt and/or low profile type within the antideformation structure which exerts only a slight embossing or indenting action on the printing material sheet, and a comparatively acute and/or high profile type which exerts a greater embossing or indenting action in a region of the clamping surface adjacent to the antideformation structure.

In accordance with again another feature of the invention, the surface relief has depressions, preferably grooves, each of which within the antideformation structure has a different hollow profile than outside the antideformation structure. Each of these depressions or grooves therefore extends over the boundary of the antideformation structure which has already been mentioned several times. In its depression section lying within the antideformation structure, the depression has a different interior contour than in the region of the clamping surface adjacent to the antideformation structure. For example, each of the depressions within the antideformation structure can have a narrower or shallower (less deep) hollow profile than outside the antideformation structure. In the case in which the depressions are grooves, this means that each groove, in its groove section lying within the antideformation structure, has a flat interior contour and/or an interior contour having a small groove width, and, in its groove section extending outside the antideformation structure, has a wider interior contour and/or an interior contour having a greater groove depth. Starting from the antideformation structure, the groove width and/or depth preferably increase gradually.

In accordance with an additional feature of the invention, depressions, lying within the antideformation structure, of the surface relief have different hollow profiles than depressions, lying outside the antideformation structure, of the surface relief. For example, the depressions lying within the antideformation structure can have narrower and/or less deep hollow profiles than the depressions lying outside the antideformation structure. It is a property of the last-described refinement that the antideformation structure has various depression types, for example firstly narrow, flat grooves and secondly wide, deep groves, the one depression type being assigned to the antideformation structure and the other depression type being assigned to the region adjacent to the antideformation structure and at a further distance from the sheet corner.

According to further refinements, the surface relief can have raised profile elements with varying profiles which, for example, are substantially in the shape of truncated pyramids, and/or depressions with varying hollow profiles, for example grooves which cross one another and as a result form cross grooves.

Most of the above-described refinements have the result that the surface relief within the antideformation structure is designed to be more uniform than outside the antideformation structure or, in other words, that the macroroughness of the surface relief within the antideformation structure is less than outside the antideformation structure. This in turn results in the support proportion, related to the surface area unit, of the surface relief within the antideformation structure being greater than outside the antideformation structure. The support proportion is that surface area, relative to the unit area of the underlying clamping surface, upon which the sheet comes to lie during clamping. For example, if a raised profile element has a truncated flat top surface area that is half of its base area, the support proportion would be one half.

The gripper system according to the invention and its refinements can be a component part of a machine which processes printing material, for example a printing press or a machine for further printing material processing.

Other features which are considered as characteristic for the invention are set forth in the appended claims.

Although the invention is illustrated and described herein as embodied in a gripper system for a machine which processes printing material sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
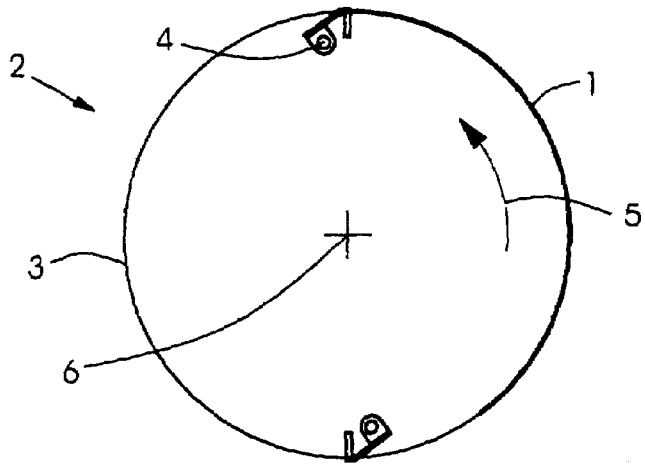
FIG. 1 is a diagrammatic side view of a sheet transport cylinder having gripper systems.

Referring now to the figures of the drawing in detail and first, particularly, to FIG. 1 thereof, there is shown a detail of a machine 2 which processes a printing material sheet 1. The machine 2, in this case, is a sheet-fed printing press. The detail shows a sheet transport device 3 having a gripper system 4 which holds the printing material sheet 1 in a clamped manner and circulates in a sheet transport direction 5 about an axis of rotation 6 of the sheet transport device 3. The sheet transport device 3 is a sheet transport cylinder and the gripper system 4 is one of two diametrically arranged gripper bars of the sheet transport cylinder.

Figure 3:
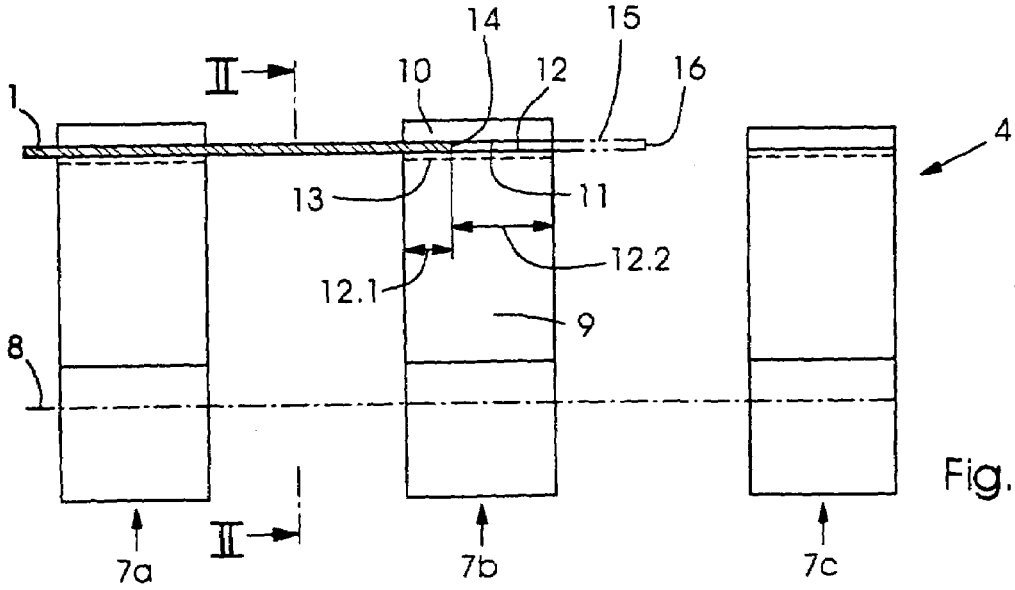
FIG. 3 is a front view of the gripper system as seen in the direction of the viewing arrow III in FIG. 2, in which the partial covering of a clamping surface of a gripper pad of the gripper system by a printing material sheet can be seen.

With reference to FIG. 3, the gripper system 4 comprises gripper/gripper pad pairs 7*a*, 7*b*, 7*c* which are arranged in a row spaced apart from one another. The alignment row of the pairs 7*a*, 7*b*, 7*c*, the axis of rotation 6 and a gripper shaft 8 of the gripper system 4 (whose center axis is only indicated in FIG. 3) are oriented parallel with respect to one another and perpendicular with respect to the sheet transport device 5.

Figure 2:
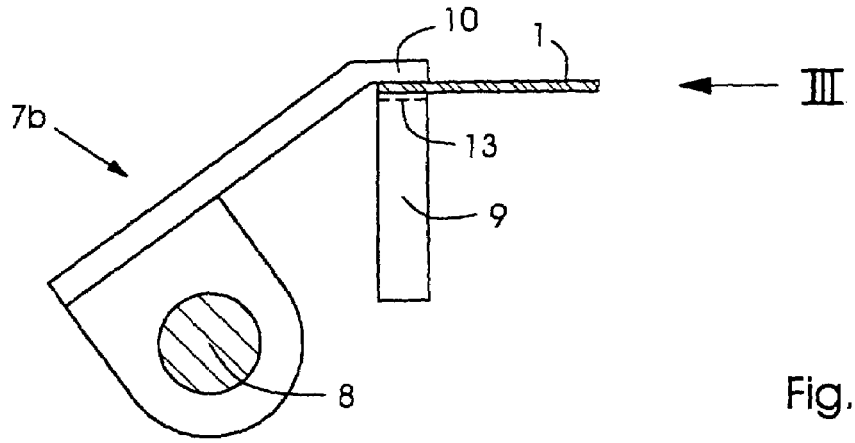
FIG. 2 is a side view of one of the gripper systems on an enlarged scale relative to the view of FIG. 1, with a plane of illustration along the section line II—II in FIG. 3.

Using the example of the gripper/gripper pad pair 7*b*, FIG. 2 shows that each of the gripper/gripper pad pairs 7*a* to 7*c* comprises a gripper pad 9 and a gripper 10 seated on the gripper shaft 8. A rotation of the gripper shaft 8, which takes place during clamping of the printing material sheet 1, makes it possible to pivot the grippers toward their gripper pads. The printing material sheet 1 which is clamped at its front sheet edge is situated between a first clamping surface 11 of the gripper and a second clamping surface 12 of the gripper pad 9. The second clamping surface 12 is provided with a surface relief 13 which results in a macroroughness and extends over a first subregion 12.1 and a second subregion 12.2 of the second clamping surface 12. The two subregions 12.1, 12.2 are delimited from one another by the course of a lateral edge 14, intersecting or crossing the second clamping surface 14 and its surface relief 13, of the printing material sheet 1 and are therefore of imaginary nature. The printing material sheet is narrower than a broad printing material-sheet 15 which can be held securely in the gripper system 4 instead of the narrow printing material sheet 1 and is indicated in FIG. 3 with a broken phantom line. The two printing material sheets 1, 15 having different formats belong to different print jobs which are to be processed one after another by way of the sheet-processing machine 2.

It can be seen in FIG. 3 that, on account of the great width of the printing material sheet 15, its lateral edge 16 would not cross the second clamping surface 12. The broad printing material sheet 15 extends in the direction of the row comprising the gripper/gripper pad pairs 7*a* to *c* and over the first subregion 12.1 and also over the second subregion 12.2 and thus completely covers the second clamping surface 12 and its surface relief 13 in said direction.

In contrast, the second clamping surface 12 and its surface relief 13 are only partially covered or only overlapped by the narrow printing material sheet 1 in said direction. The clamping force exerted by the gripper 10 is determined by a spring (not shown in the drawing) which loads the gripper 10 and has one and the same magnitude in both cases, both when gripping the narrower printing material sheet 1 and when gripping the broader printing material sheet 15. Said clamping force acts on the broad printing material sheet 15, when gripping the latter, in a manner distributed over the two subregions 12.1 and 12.2, that is to say the whole second clamping surface 12, but on the narrow printing material sheet 1, when gripping the latter, only within the first subregion 12.1 and not within the second subregion 12.2 which is not covered by the narrow printing material sheet 1. For this reason, the surface pressure which is produced by the clamping force when clamping the narrow printing material sheet within the first subregion 12.1 is much greater than the surface pressure which is produced by the same clamping force when clamping the broad printing material sheet 15 within the whole second clamping surface 12. The clamping force and the surface relief 13 are coordinated with one another in such a way that firstly, when clamping the broad printing material sheet 15, the surface relief 13 only digs or is pressed into the broad printing material sheet 15 to such a depth that secure holding of the printing material sheet 15 in the gripper system 4 is ensured and the printing material sheet 15 cannot slip, and secondly is not pressed in to such a depth that the printing material sheet is deformed excessively as a result.

As a result, without a suitable countermeasure there would be the risk that, given a reduced effective area of the clamping force and accordingly an increased surface pressure during the clamping of the narrow printing material sheet 1, the surface relief 13 or its raised profile elements 21, 22, 26 (cf. FIGS. 4 to 9) press too deeply into the printing material sheet 1 and deform the latter excessively as a result at the corresponding pressing or clamping point.

The countermeasure, according to the invention, which prevents such damage to the narrow printing material sheet 1 consists in structuring or profiling of the surface relief 13 which varies from region to region, that is to say the profile elements 21, 22, 26 are configured differently from relief section or region to relief section or region of the surface relief 13. The surface relief 13 therefore comprises a special relief section, within which the surface relief 13 has an antideformation structure 18 which reduces the surface pressure and as a result prevents the excessive deformation of the narrow printing material sheet 1. This special relief section is a decentral relief section with regard to the clamping surface 12 or its surface relief 13. The surface relief 13 needs no antideformation structure or at least no antideformation structure of equivalent efficacy in another, central relief section of the surface relief 13. The decentral relief section provided with the highly effective antideformation structure 18 can be somewhat smaller than, exactly as large as, or somewhat larger than the first subregion 12.1.

Although, for better understanding of the invention, it is assumed in some of the variants of the antideformation structure 18 shown in FIGS. 4 to 9 that the relief section comprising the antideformation structure 18 and the first subregion 12.1 are absolutely congruent, that is to say equally large, it should be expressly emphasized here that this is not absolutely necessary for the proper functionality and efficiency.

The narrow printing material sheet 1 shown in FIG. 3 covers approximately one third of the second clamping surface 12. If, for example, a different narrow format printing material sheet covered even two thirds of the second clamping surface 12 in practice, there would admittedly no longer be absolute congruence between the first subregion, covered by the sheet, of the second clamping surface 12 and the relief section having the antideformation structure 18 (the relief section would be smaller in this scenario than the first subregion covered by the sheet), but the antideformation structure 18 would still nevertheless act sufficiently to reduce sheet deformation.

FIGS. 4 to 9 show different exemplary embodiments of the surface relief 13. For the purpose of a clear view of the surface relief 13, the printing material sheet 1 is indicated in said FIGS. 4 to 9 only using phantom lines and the gripper 10 is omitted in the drawing.

In each exemplary embodiment, the depressions (specifically: grooves) necessary to form the surface relief 13 are made in the clamping surface 12 by means of a grinding or milling tool in a material-removing process. The protrusions (specifically: profile elements) which are likewise necessary to form the surface relief 13 remain between the depressions.

In the exemplary embodiments according to FIGS. 4 to 8, grooves 19.1, 19.2 which extend in parallel with respect to one another form a first groove group 19 and grooves 20.1, 20.2 which likewise extend in parallel with respect to one another form a second groove group 20. The groove groups 19, 20 intersect one another at right angles and extend obliquely at 45° angles relative to the lateral edge 14 of the printing material sheet 1. Small bulges in the shape of truncated pyramids form the raised profile elements 21, 22 delimited by the grooves 19.1, 19.2, 20.1, 20.2 and are therefore arranged in a grid. The grooves 19.1, 19.2, 20.1, 20.2 have a substantially V-shaped groove cross section.

Figure 4:
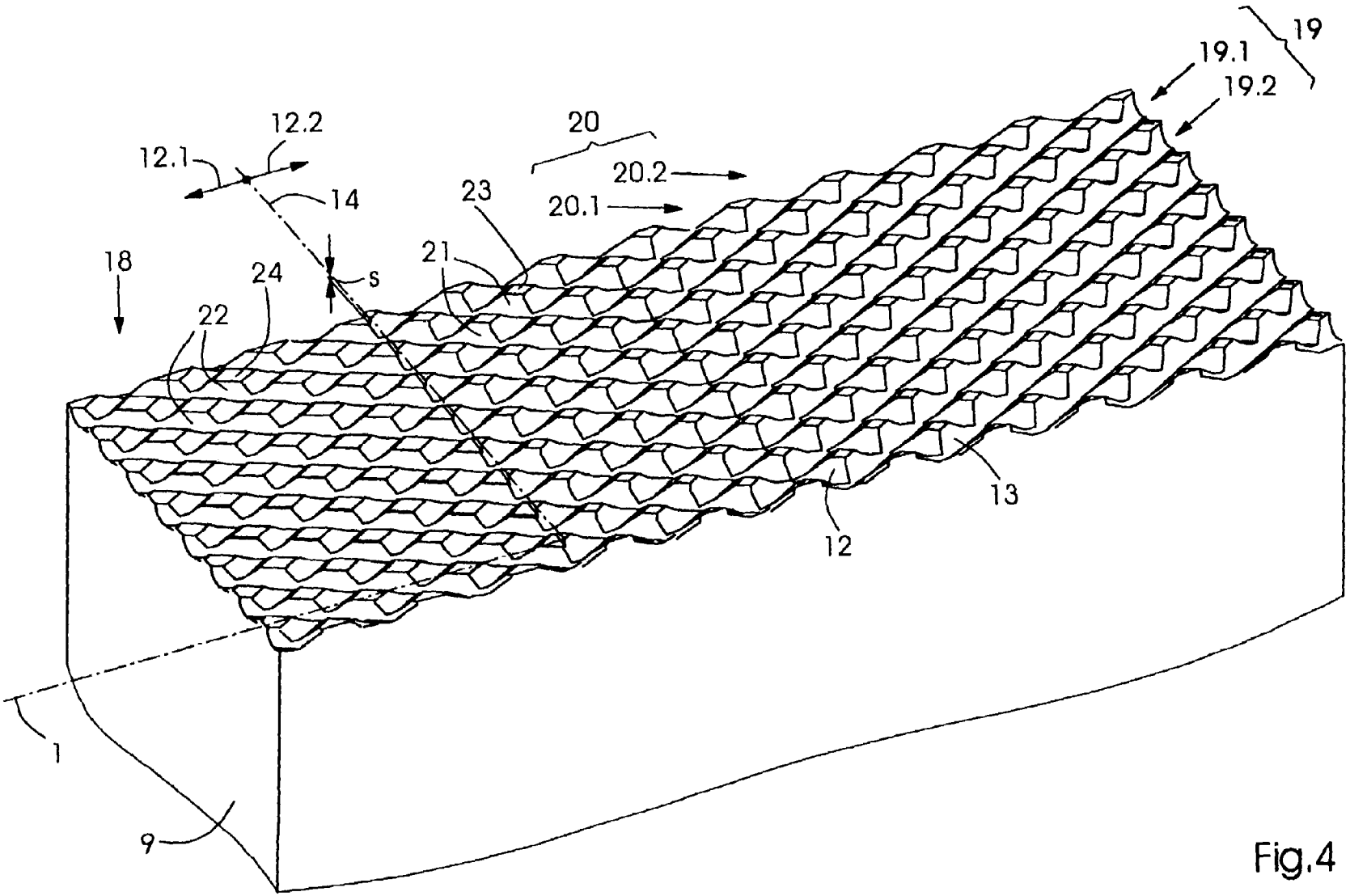
FIGS. 4 to 9 are partial perspective views of different exemplary embodiments of a surface relief according to the invention, comprising an antideformation structure, of the clamping surface which is only partially covered by the printing material sheet.

In a preceding intermediate stage (not shown in the drawing) of the material-removing relief processing, the profile elements 22 placed within the first subregion 12.1 had exactly the same external shape as the profile elements 21 placed in the second subregion 12.2. The antideformation structure 18, which is exactly as large as the first subregion 12.1 in the exemplary embodiment corresponding to FIG. 4, has been produced in a production step following the intermediate stage, in that the surface relief 13 has been flattened somewhat only within the region of the antideformation structure 18 by means of grinding or milling over said surface relief 13, or in that the profile elements 22 which form the antideformation structure 18 have been flattened somewhat by said grinding or milling over. FIG. 4 clearly shows that the profile elements 22 of the antideformation structure 18 are somewhat less acute than the relatively blunt profile elements 21 lying outside the antideformation structure 18. In other words, plateaus 23 of the profile elements 21 are in each case smaller in area terms than plateaus 24 of the profile elements 22. Related to a surface area unit, for example a square centimeter, the plateaus 24 are larger in area terms in total than the plateaus 23 in total related to a surface area unit. The plateaus 23, 24 form the sheet-bearing surface parts of the surface relief 13, what are referred to as support proportions. The support proportion, related to a surface area unit, is greater in the region of the antideformation structure 18 than the support proportion, related to a surface area unit, outside the antideformation structure 18, for which reason, in the region of the antideformation structure 18, the surface pressure exerted on the printing material sheet 14 by the clamping surface 12 or its surface relief 13 is reduced. In order to achieve this to a sufficient extent, it is already sufficient for the surface relief 13 to be lowered by a step height s of approximately 0.1 millimeter compared with the remaining region of the surface relief 13.

Figure 5:
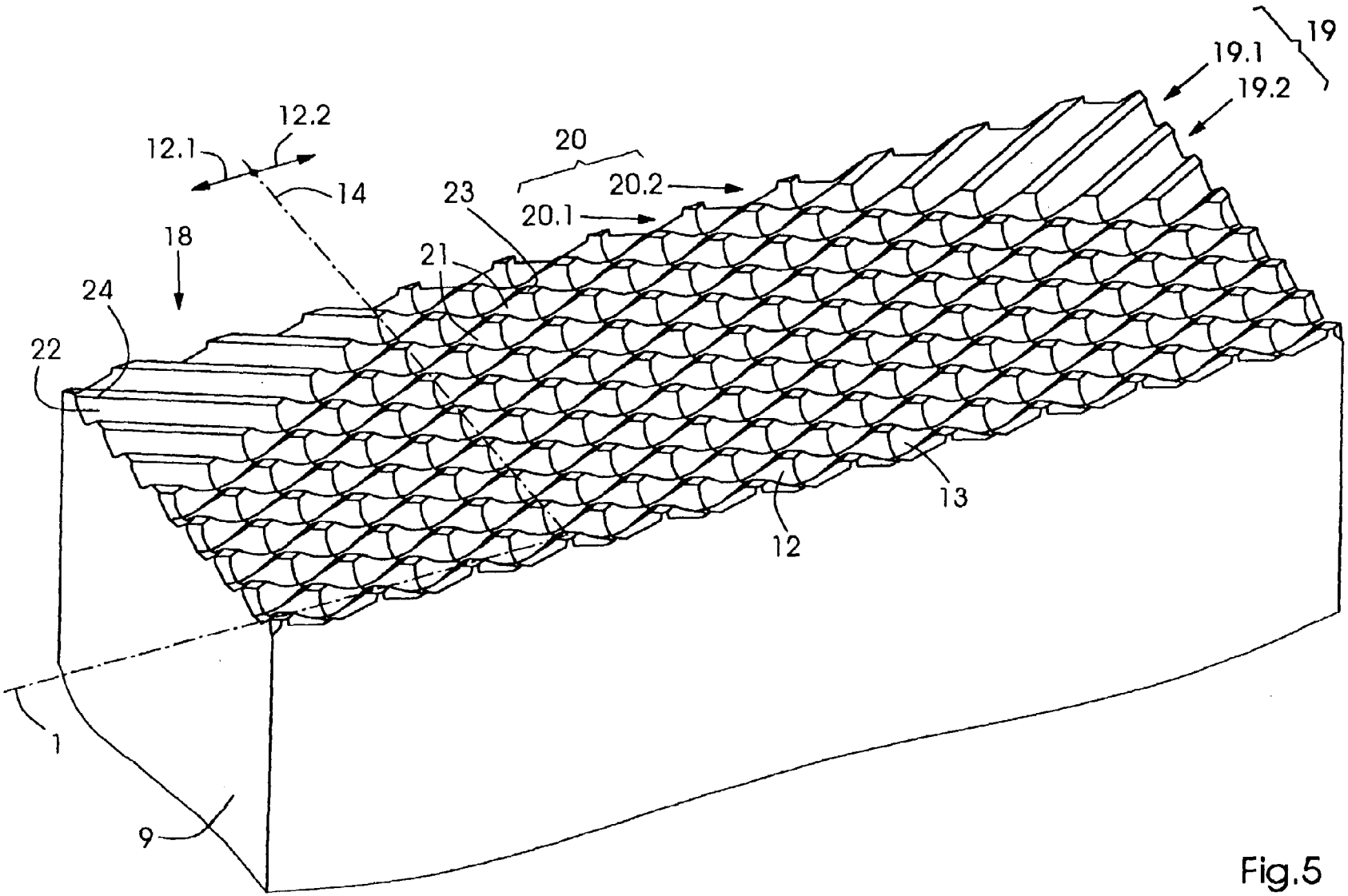

In the exemplary embodiment according to FIG. 5, the antideformation structure 18 is formed by only the first groove group 19 being continued over the whole clamping surface 12 and not the second groove group 20. In each case only the grooves 19.1, 19.2, 20.1, 20.2 of one of the two groove groups 19, 20 are made in the corner region of the clamping surface 12, and not the grooves of the other groove group, with the result that the profile elements 21 are in the shape of truncated pyramids in the central region and the profile elements 22 are in the shape of parapets in the corner region. The first and second groove groups intersect in the substantially triangular or trapezoidal central region, so that the result is the grid structure already known from FIG. 4. No grooves intersect in the decentral (corner) region, so that there the surface relief 13 results in ribbing or fluting which extends obliquely with respect to the lateral edge 14 of the printing material sheet 1 at an angle of 45°. On average, the plateaus 24 of the decentral profile elements 22 are longer and larger than the plateaus 23 of the central profile elements 21. As a consequence, what is known as the support proportion, related to a surface area unit, of the surface relief 13 in the first subregion 12.1 or inside the antideformation structure 18 is greater than in the second subregion 12.2 or outside the antideformation structure 18.

Figure 6:
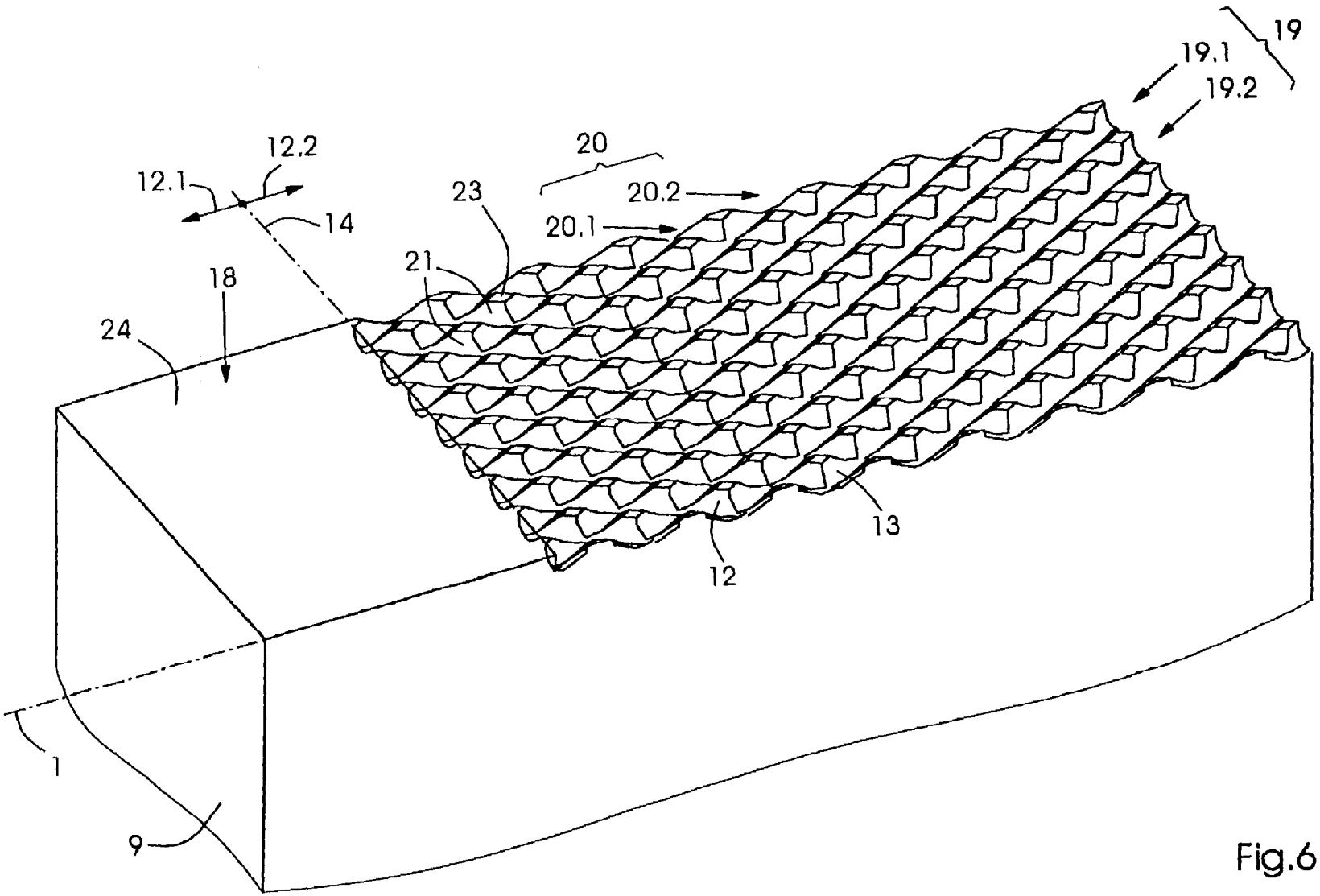

In the exemplary embodiment according to FIG. 6, the whole clamping surface 12 has been provided with the cross groove structure already known from FIGS. 4 and 5 in a first processing step. Subsequently, part of the crossing grooves 19.1, 19.2, 20.1, 20.2 is closed again by means of a sealant, for example of epoxy resin, in the edge region, lying under the sheet corner protruding into the clamping surface 12, of the clamping surface 12 for the purpose of forming the antideformation structure 18. The surface relief 13 thus has a multiplicity of profile elements 21 outside the antideformation structure 18 and, in contrast, has only a single raised profile element 22 or plateau 24 in the region of the antideformation structure 18.

Figure 7:
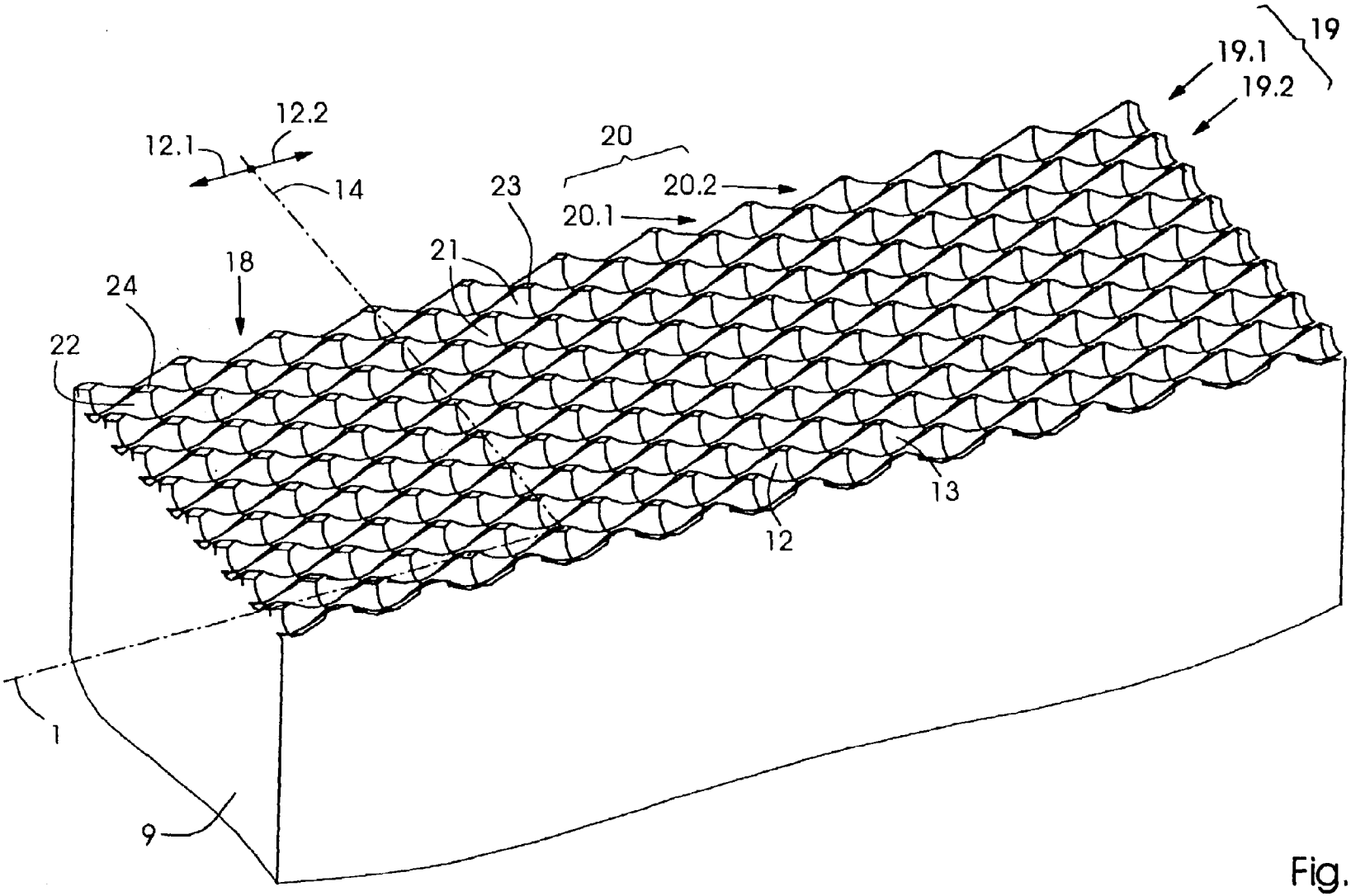

In the exemplary embodiment according to FIG. 7, the whole clamping surface 12 is covered with the grid structure formed from the crossing groove groups 19, 20. This cross groove structure of the surface relief 13 changes continuously, however, with regard to what is referred to as its support proportion, related to a surface area unit, in the direction of extent perpendicular to the lateral edge 14 of the printing material sheet 1. During production of the surface relief 13, a tool used for this purpose has specifically been set obliquely in such a way that the groove depth of the grooves 19.1, 19.2, 20.1, 20.2 increases in said direction of extent. The further the respective profile element 21, 22 is situated from the lateral edge of the clamping surface 12 which is covered by the printing material sheet 1, the smaller is the plateau 23, 24 of the profile elements 21, 22 in the shape of truncated pyramids, or the more acute are these profile elements 21, 22, or the smaller is the support proportion related to a surface area unit. The support proportion related to a surface area unit is higher in the region of the antideformation structure 18 lying under the sheet corner of the printing material sheet 1 than in an equally large region of the surface relief 13 which is not covered by the sheet corner.

Figure 8:
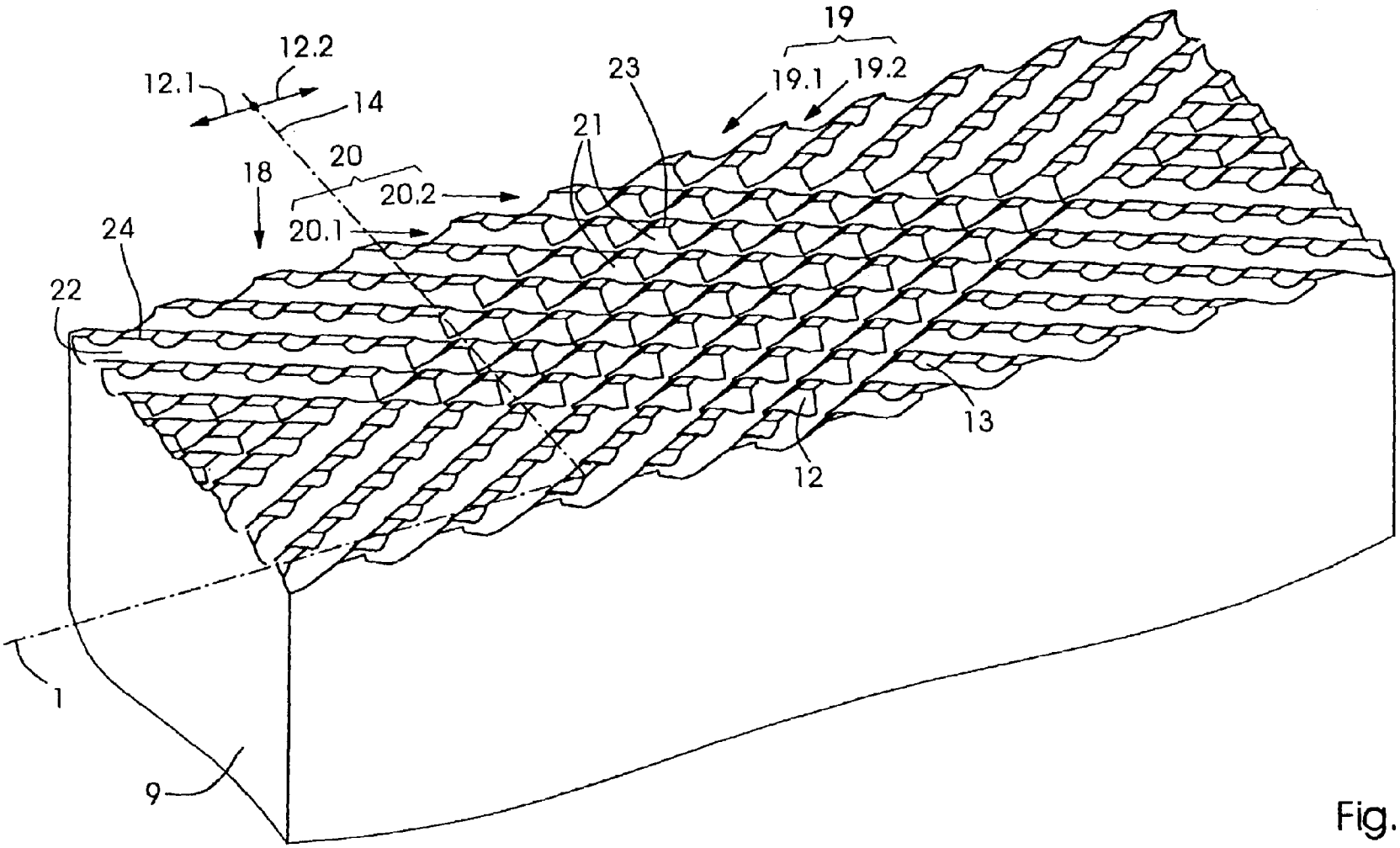

In the exemplary embodiment according to FIG. 8, of every one of the intersecting groove groups 19, 20, in each case only those grooves 19.1, 19.2, 20.1, 20.2 lying centrally with respect to the clamping surface 12 are configured to be deep and the remaining grooves are configured to be less deep. As a consequence, the surface relief 13 has a central region formed from deep cross grooves and in the shape of a parallelogram, and decentral regions which are formed from flat cross grooves, form the antideformation structure 18 and in which the support proportion related to a surface area unit is higher than in the central region. The grid structure resulting from the cross grooves in the central region corresponds to the grid structure already known from FIGS. 4 to 6 and accordingly comprises profile elements 21 in the shape of truncated pyramids and having square plateaus 23. In contrast, the antideformation structure 18 is distinguished by profile elements 22 which are in the shape of parapets and each have a ridge interrupted by the flat grooves. The plateau 24 of the profile elements 22 of the antideformation structure 18 is therefore elongate.

Figure 9:
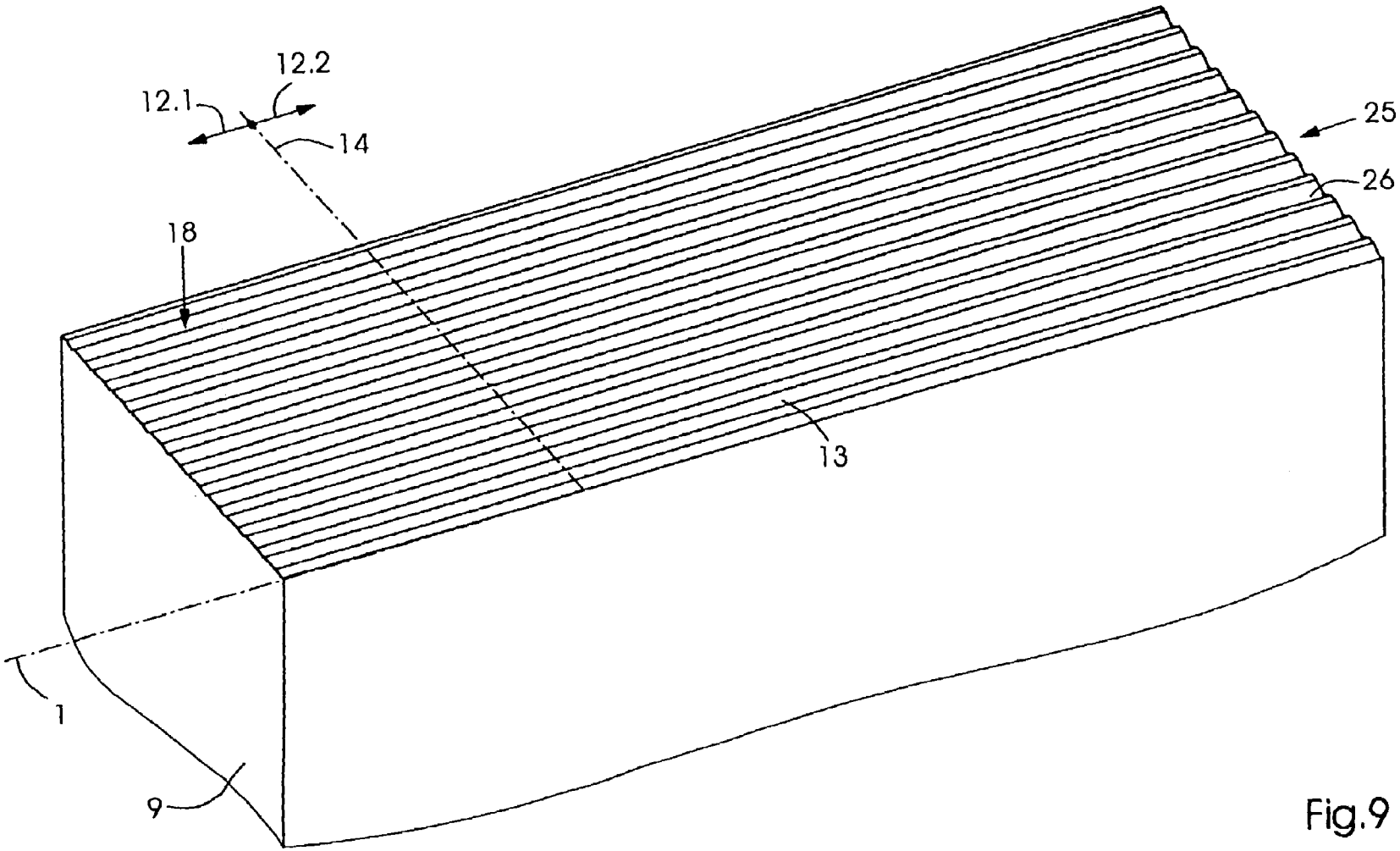

In the exemplary embodiment according to FIG. 9, in contrast to the previously explained exemplary embodiments, there is only one groove group which forms the fluted or ribbed surface relief 13. The grooves 25 of this groove group and the profile elements 26 lying in between extend at right angles with respect to the lateral edge 14 of the printing material sheet 1. At an increasing distance from the printing material sheet 1, the depth of the grooves and the height of the profile elements 26 in the shape of parapets increase continuously. Accordingly, the surface relief 13 is more uniform or has a lesser macroroughness in the region of the antideformation structure 18 than outside this region. At an increasing distance from the printing material sheet 1, however, the width of the grooves 25 also increases continuously and the width of the plateaus of the profile elements 26 decreases continuously (the two widths are to be measured in a direction parallel with respect to the lateral edge 14 of the printing material sheet 1). Accordingly, at an increasing distance from the printing material sheet 1, what is referred to as the support proportion, related to a surface area unit, of the surface relief 13 is also reduced and said support proportion is greater in the region of the antideformation structure 18 than outside this region.

This application claims the priority, under 35 U.S.C. § 119, of German patent application No. 103 25 376.9, filed Jun. 5, 2003; the entire disclosure of the priority application is herewith incorporated by reference.

We claim:

1. A gripper system for a sheet-processing machine, comprising:

a gripper having a first clamping surface;

a gripper pad disposed to cooperate with said gripper and having a second clamping surface;

at least one of said first and second clamping surfaces having a surface relief and being disposed such that, when gripping a relatively narrow printing material sheet, the sheet covers only a subregion of said clamping surface and, when gripping a relatively broad printing material sheet, the sheet covers said clamping surface beyond said subregion; and said surface relief having a structure within said subregion different from a structure of said clamping surface outside said subregion, and said structure within said subregion having an antideformation structure protecting the narrow printing material sheet against excessive clamping deformation.

2. The gripper system according to claim 1, wherein said surface relief within said antideformation structure has at least one raised profile element with a different design than raised profile elements of said surface relief outside said antideformation structure.

3. The gripper system according to claim 2, wherein said at least one raised profile element within said antideformation structure is less sharp than said raised profile elements outside said antideformation structure.

4. The gripper system according to claim 2, wherein said at least one raised profile element within said antideformation structure is lower, relative to said clamping surface, than said raised profile elements outside said antideformation structure.

5. The gripper system according to claim 2, wherein said at least one raised profile element is one of a plurality of raised profile elements within said antideformation structure.

6. The gripper system according to claim 1, wherein said surface relief is formed with raised profile elements, and each of said profile elements within said antideformation structure has a different profile from said profile elements outside said antideformation structure.

7. The gripper system according to claim 6, wherein each of said raised profile elements within said antideformation structure has a blunter profile than said profile elements outside said antideformation structure.

8. The gripper system according to claim 6, wherein each of said raised profile elements within said antideformation structure has a lower profile than said profile elements outside said antideformation structure.

9. The gripper system according to claims 1, wherein said surface relief is formed with depressions, and each of said depressions within said antideformation structure has a hollow profile different from said depressions outside said antideformation structure.

10. The gripper system according to claim 9, wherein each of said depressions within said antideformation structure has a narrower hollow profile than said depressions outside said antideformation structure.

11. The gripper system according to claim 9, wherein each of said depressions within said antideformation structure has a shallower hollow profile than said depressions outside said antideformation structure.

12. The gripper system according to claim 1, wherein said depressions of said surface relief within said antideformation structure have different hollow profiles than said depressions of said surface relief outside said antideformation structure.

13. The gripper system according to claim 12, wherein said depressions within said antideformation structure have narrower hollow profiles than said depressions outside said antideformation structure.

14. The gripper system according to claim 12, wherein said depressions within said antideformation structure have shallower hollow profiles than said depressions outside said antideformation structure.

15. The gripper system according to claim 1, wherein said surface relief is formed with raised profile elements having varying profiles.

16. The gripper system according to claim 1, wherein said surface relief is formed with depressions (grooves 19.1, 19.2, 20.1, 20.2) having varying hollow profiles.

17. The gripper system according to claim 1, wherein said surface relief is formed with raised profile elements having varying profiles, and with mutually intersecting cross grooves having varying hollow profiles.

18. The gripper system according to claim 1, wherein said surface relief is formed with a network of cross grooves.

19. The gripper system according to claim 1, wherein said surface relief is defined with profile elements having substantially a shape of truncated pyramids.

20. The gripper system according to claim 1, wherein said surface relief within said antideformation structure is more uniform than said surface relief outside said antideformation structure.

21. The gripper system according to claim 1, wherein a macroroughness of said surface relief within the antideformation structure has a value less than a macroroughness outside said antideformation structure.

22. The gripper system according to claim 1, wherein said surface relief of said clamping surface is defined by a support proportion relative to a surface area unit, and said support proportion of said surface relief within said antideformation structure is greater than said support proportion outside said antideformation structure.

23. In combination with a machine for processing printing material sheets, the gripper system according to claim 1 formed with at least one of said grippers and at least one of said gripper pads.

* * * * *